US009117597B2

(12) United States Patent
McClung et al.

(10) Patent No.: US 9,117,597 B2
(45) Date of Patent: Aug. 25, 2015

(54) SELF-ALIGNING PORTABLE ACTUATOR FOR REMOTELY OPERATING A POWER CIRCUIT BREAKER

(71) Applicant: MarTek Limited, Charleston, WV (US)

(72) Inventors: Charles Mark McClung, Elkview, WV (US); Russell Richard Safreed, III, St. Albans, WV (US)

(73) Assignee: MARTEK LIMITED, Charleston, WV (US)

( * ) Notice: Subject to any disclaimer, the term of this patent is extended or adjusted under 35 U.S.C. 154(b) by 134 days.

(21) Appl. No.: 14/101,636

(22) Filed: Dec. 10, 2013

(65) Prior Publication Data

US 2014/0209443 A1 Jul. 31, 2014

Related U.S. Application Data

(60) Provisional application No. 61/756,636, filed on Jan. 25, 2013.

(51) Int. Cl.

| | |
|---|---|
| ***H01H 3/20*** | (2006.01) |
| ***H01H 3/02*** | (2006.01) |
| ***H01H 3/54*** | (2006.01) |
| ***H01H 71/10*** | (2006.01) |
| *H01H 3/10* | (2006.01) |

(52) U.S. Cl.

CPC . *H01H 3/02* (2013.01); *H01H 3/54* (2013.01); *H01H 71/1018* (2013.01); *H01H 2003/105* (2013.01)

(58) Field of Classification Search

CPC ..... H01H 3/00; H01H 3/02; H01H 9/02; H02B 11/127

USPC ..... 200/295, 303, 329, 330, 331; 361/614

See application file for complete search history.

(56) References Cited

U.S. PATENT DOCUMENTS

| | | | | |
|---|---|---|---|---|
| 5,288,958 | A * | 2/1994 | Grunert et al. | 200/331 |
| 5,319,168 | A * | 6/1994 | Hutko et al. | 200/331 |
| 6,437,262 | B1 * | 8/2002 | Gupta et al. | 200/50.19 |
| 7,482,548 | B2 * | 1/2009 | Periot et al. | 200/400 |
| 2005/0139461 | A1 * | 6/2005 | McClung | 200/330 |

* cited by examiner

*Primary Examiner* — Vanessa Girardi

(74) *Attorney, Agent, or Firm* — Thomas | Horstemeyer, LLP

(57) ABSTRACT

A portable actuator assembly for remotely operating the control components on a circuit breaker which self-aligns by engaging a recessed area of the circuit breaker. The portable actuator assembly is easily and accurately aligned with the control components on the circuit breaker by an alignment fixture that engages the recessed area of the circuit breaker. The alignment fixture is moveable along one axis that lies perpendicular to the face of the circuit breaker in order to compensate for variations between the plane of the face of the circuit breaker and the plane of the sheet metal enclosure surrounding the circuit breaker. The alignment fixture is forced toward the face of the breaker by spring action to ensure it remains in constant contact with the circuit breaker. Strong magnets may hold the portable actuator assembly against the circuit breaker by attaching to the sheet metal enclosure surrounding the circuit breaker.

17 Claims, 11 Drawing Sheets

SELF-ALIGNING PORTABLE ACTUATOR FOR REMOTELY OPERATING A POWER CIRCUIT BREAKER

CROSS-REFERENCE TO RELATED APPLICATIONS

This application claims priority to copending U.S. Provisional Patent Application titled "Self-Aligning Portable Actuator for Remotely Operating a Power Circuit Breaker," filed on Jan. 25, 2013 and assigned application No. 61/756,636, which is incorporated by reference herein in its entirety.

BACKGROUND

Anyone versed in the operation of large power circuit breakers will understand the hazards and risks associated with operating power circuit breakers. Many types of power circuit breakers require a human operator to depress one or more pushbuttons located on the face of the circuit breaker to effect opening or closing of the breaker. Some portable actuators for remotely operating power circuit breakers are not easily installed. Some portable actuators must be manually adjusted and visually aligned with the pushbuttons on the circuit breaker. The process of installing the portable actuator is time-consuming and subject to misalignment.

SUMMARY

The present disclosure satisfies the need of a portable remote circuit breaker actuator that can be easily and accurately aligned with a circuit breaker's pushbuttons and/or other control components. One embodiment of an apparatus, among others, includes an apparatus for remotely operating circuit breakers, the apparatus comprising: a portable actuator comprising one or more linear actuators that are designed to operably extend from a housing of the portable actuator and engage with one or more control components positioned within a recessed area of a circuit breaker; and an alignment fixture comprising one or more apertures, the alignment fixture being mounted to one or more moveable guide shafts extending from a face of the portable actuator such that the one or more apertures are substantially aligned with the one or more linear actuators, and the alignment fixture being designed to engage and substantially align with the recessed area of the circuit breaker thereby providing access for the one or more linear actuators to engage with the one or more control components.

Also included is at least one embodiment of a method for aligning a portable actuator assembly to a circuit breaker. The method may be summarized by the following steps: positioning an alignment fixture of the portable actuator assembly on the circuit breaker such that an aperture of the alignment fixture is aligned with a control component of the circuit breaker, the alignment fixture being mounted to a portable actuator via one or more moveable guide shafts extending from a face of the portable actuator; moving the alignment fixture to compress compression springs extending the one or more moveable guide shafts; and securing the portable actuator assembly to a metal enclosure surrounding the circuit breaker to maintain a constant force between the alignment fixture and the circuit breaker.

These and other aspects, objects, features, and embodiments will become apparent to a person of ordinary skill in the art upon consideration of the following detailed description of illustrative embodiments exemplifying the best mode as presently perceived.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the present disclosure. Like reference numerals designate corresponding parts throughout the several views.

DETAILED DESCRIPTION

Figure 1:
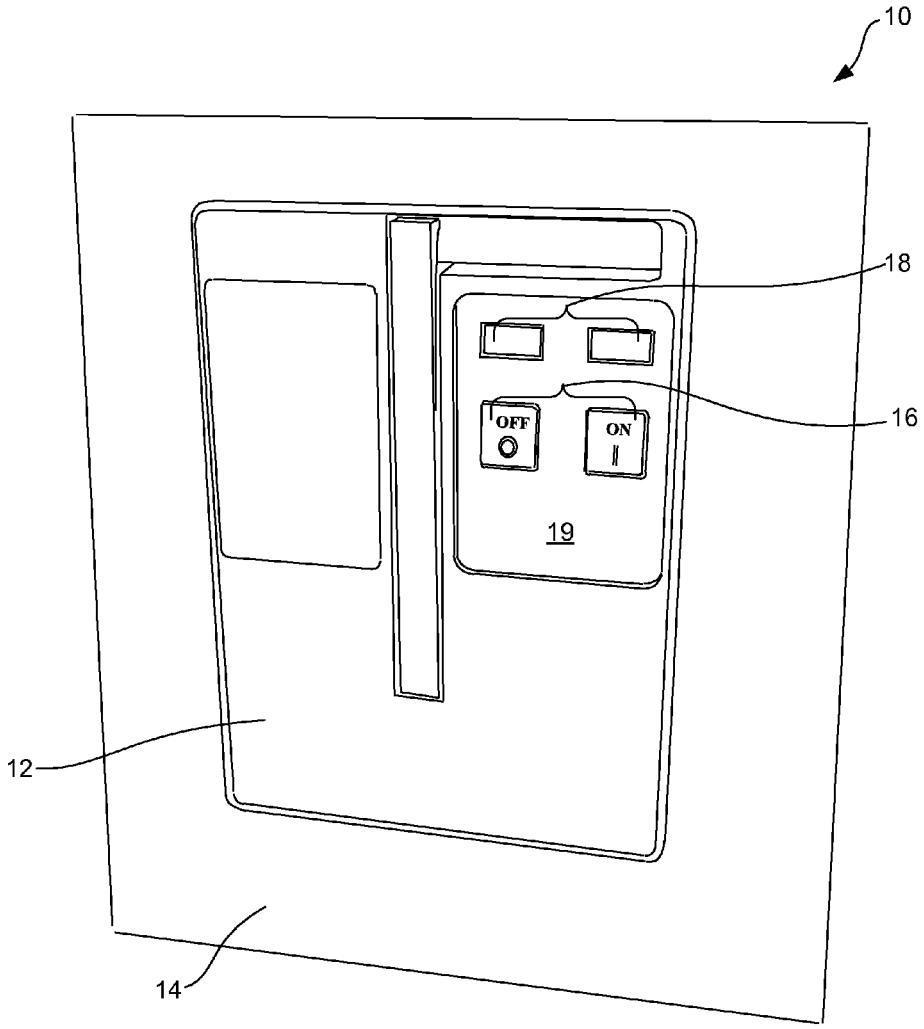
FIG. 1 depicts a drawing of an example of a typical power circuit breaker.

With reference to FIG. 1, shown is a drawing of a non-limiting example of a circuit breaker assembly 10 comprising a power circuit breaker 12 within a sheet metal enclosure 14. The circuit breaker 12 depicted may comprise control components 16 and status components 18 that are situated within a recessed area 19 on the face of the circuit breaker 12. The control components 16 may correspond to the controls (e.g., ON/OFF controls) used to operate the circuit breaker 12. While the control components 16 are illustrated as pushbuttons, it should be noted that any other appropriate switch may be used to operate the circuit breaker 12. The status components 18 may correspond to status indicators corresponding to various statuses of the circuit breaker 12, such as, for example, a breaker status flag, an operating status flag, and/or other status components that would be appropriate for the circuit breaker 12. In various embodiments, the circuit breaker 12 may contain more or less control components 16 and/or status components 18 than those illustrated in FIG. 1.

Figure 2A:
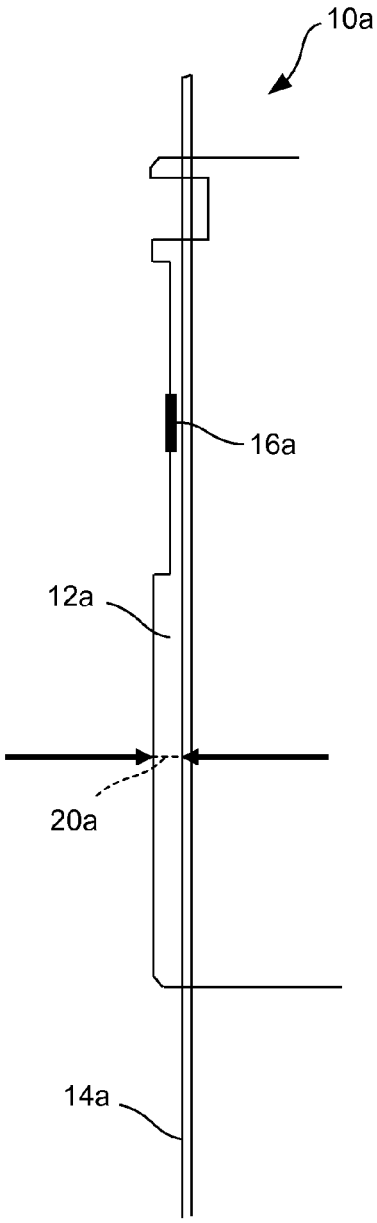
FIGS. 2A and 2B depict a variation that may exist between the plane of the face of the circuit breaker and the plane of the sheet metal enclosure, among circuit breakers of a similar style as the circuit breaker of FIG. 1.
Figure 2B:
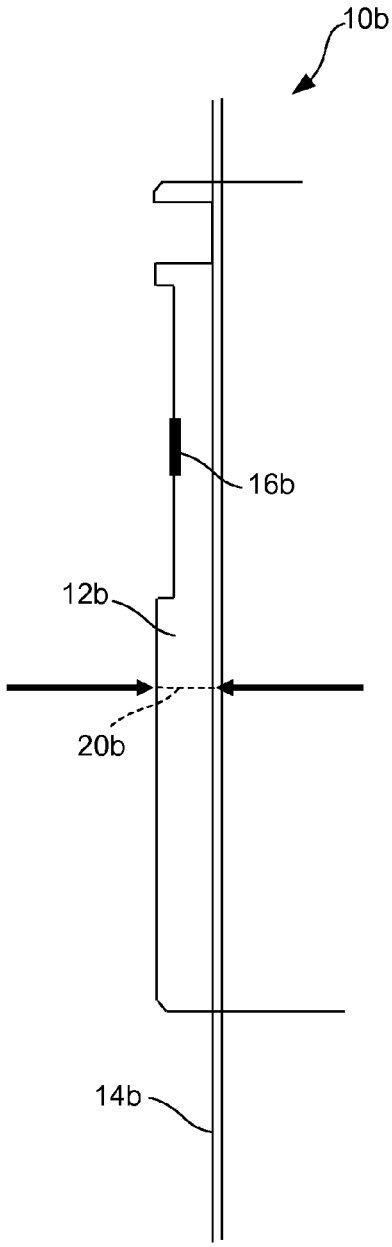

Moving on to FIGS. 2A and 2B, shown are drawings of non-limiting examples of two sectional side views of two circuit breaker assemblies 10*a*, 10*b* (hereinafter referred to as "10") that are similar to the circuit breaker assembly 10 illustrated in FIG. 1. Contrast is depicted between the two sectional side views of FIGS. 2A and 2B to show the variation that may exist between various installations of the same style power circuit breaker 12. In FIG. 2A the distance 20*a* between the plane of the face of the power circuit breaker 12*a* and the plane of the sheet metal enclosure 14*a* is less than the distance 20*b* between similar planes of the power circuit breaker 12*b* and the sheet metal enclosure 14*b* as depicted in FIG. 2B.

Figure 3:
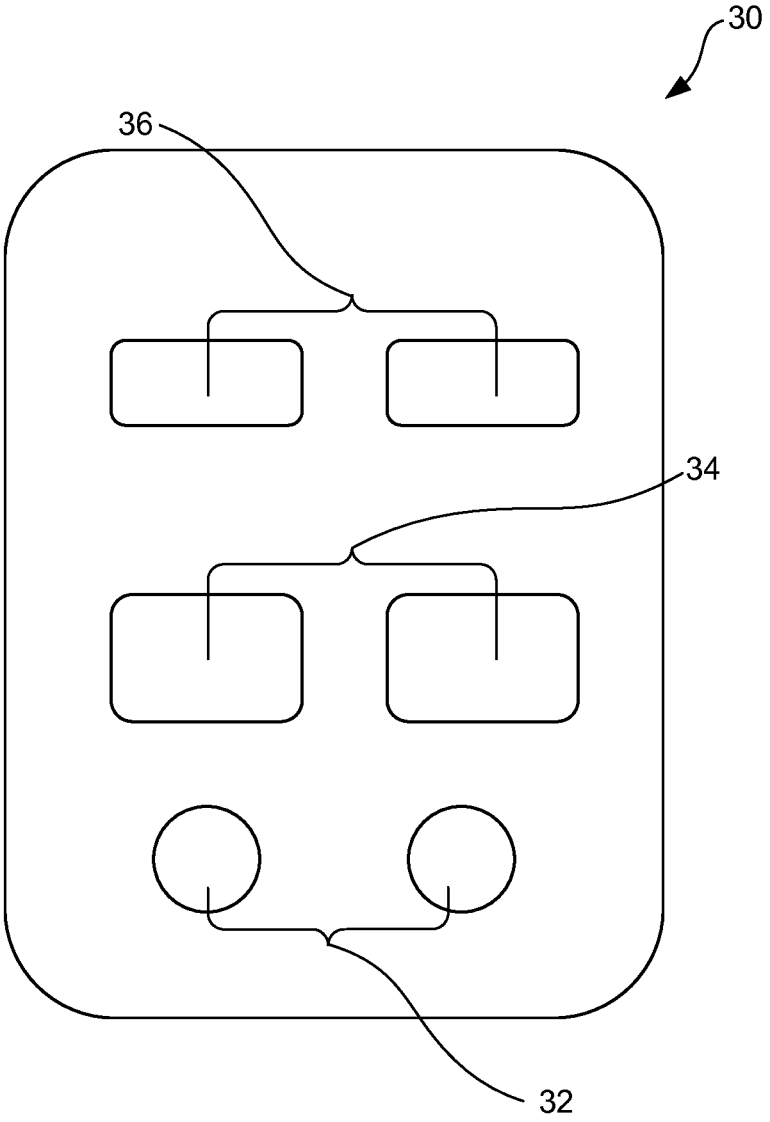
FIG. 3 is a drawing of an example of an outline of an alignment fixture that may engage with the circuit breaker of FIG. 1 according to various embodiments of the present disclosure.

Turning now to FIG. 3, shown is a drawing of a non-limiting example of an alignment fixture 30 that approximates the size and shape of the recessed area 19 (FIG. 1) of the circuit breaker 12 (FIG. 1). As will be discussed in greater detail with reference to FIG. 4, the alignment fixture 30 may be mounted to one or more moveable guide shafts 42 (FIG. 4) extending from a portable actuator 40 (FIG. 4) and may be used as an intermediary component positioned between the portable actuator 40 and the circuit breaker 12. The alignment fixture 30 may include mounting apertures 32, control apertures 34, and/or status apertures 36. The mounting apertures 32 may be used to mount the alignment fixture 30 to the moveable guide shafts 42. The control apertures 34 and status apertures 36 correspond to the control components 16 (FIG. 1) and status components 18 (FIG. 1) of the circuit breaker 12. The control apertures 34 and status apertures 36 may approximate the size and shape of the corresponding control components 16 and status components 18. The control apertures 34 are sized and positioned in the alignment fixture 30 to provide access for the portable actuator 40 to the control components 16 when the alignment fixture 30 is engaged with the recessed area 19 (FIG. 1) of the circuit breaker 12. The status apertures 36 provide viewing access to the status components 18, as illustrated in FIG. 1, when the alignment fixture 30 is engaged with the recessed area 19 of the circuit breaker 12.

Figure 4:
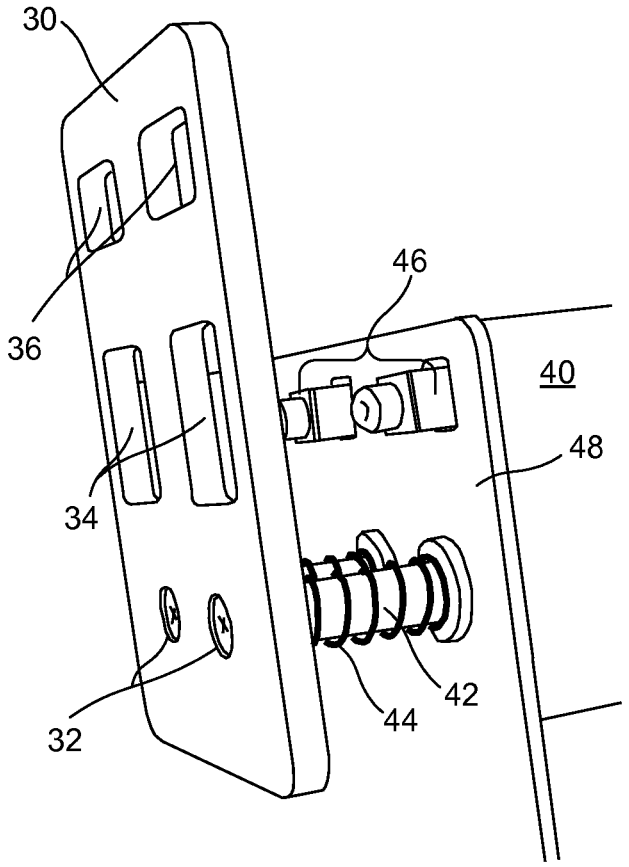
FIG. 4 is a drawing of an example of a mounting configuration of the alignment fixture of FIG. 3, relative to a portable actuator according to various embodiments of the present disclosure.

Referring next to FIG. 4, shown is a drawing of a non-limiting example of the alignment fixture 30 mounted onto two moveable guide shafts 42 extending from a portable actuator 40. The portable actuator 40 is a device that may be used to remotely operate the control components 16 (FIG. 1) of a circuit breaker 12 (FIG. 1). A non-limiting example of a portable actuator 40 is discussed in greater detail in U.S. Pat. No. 7,623,011, issued Nov. 24, 2009, and entitled "Device for Remotely Operating a Circuit Breaker Apparatus and Associated Assembly and Method," which is hereby incorporated by reference in its entirety.

The portable actuator 40 illustrated in FIG. 4 comprises two moveable guide shafts 42 and two linear actuators 46 both extending from the face 48 of the portable actuator 40. The moveable guide shafts 42 are designed to slide perpendicular to the plane of the face 48 of portable actuator 40 from which they extend. As such, the moveable guide shafts 42 slide perpendicular to the plane of the face of the power circuit breaker 12 when the alignment fixture 30 is engaged within the recessed area 19 (FIG. 1) of the circuit breaker 12.

The alignment fixture 30 is mounted to the portable actuator 40 via the moveable guide shafts 42 such that the control apertures 34 of the alignment fixture 30 are substantially parallel to and aligned with the linear actuators 46 of the portable actuator 40. When positioned about the face of the circuit breaker 12, the alignment fixture 30 is forced toward the face of the circuit breaker 12 by means of compression springs 44 extending the moveable guide shafts 42. As such, the position of the alignment fixture 30 may be adjusted along the plain of movement of the moveable guide shafts 42 to compensate for variations between the plane of the face of the circuit breaker 12 and the plane of the sheet metal enclosure 14 (FIG. 1) surrounding the circuit breaker as illustrated by example in FIGS. 2A and 2B. In some embodiments, the control components 16 may extend through the control apertures 34 in the alignment fixture 30. It should be noted that although the compression springs 44 are shown to surround the moveable guide shafts 42 in FIG. 4, the compression springs 44 may be positioned relative to the moveable guide shafts 42 in alternative configurations so long as the compression springs 44 extend the moveable guide shafts 42. For example, the ends of the moveable guide shafts 42 may be affixed to the compression springs 44 such that the compression springs 44 push on the ends of the moveable guide shafts 42, thereby extending the moveable guide shafts 42.

Figure 5:
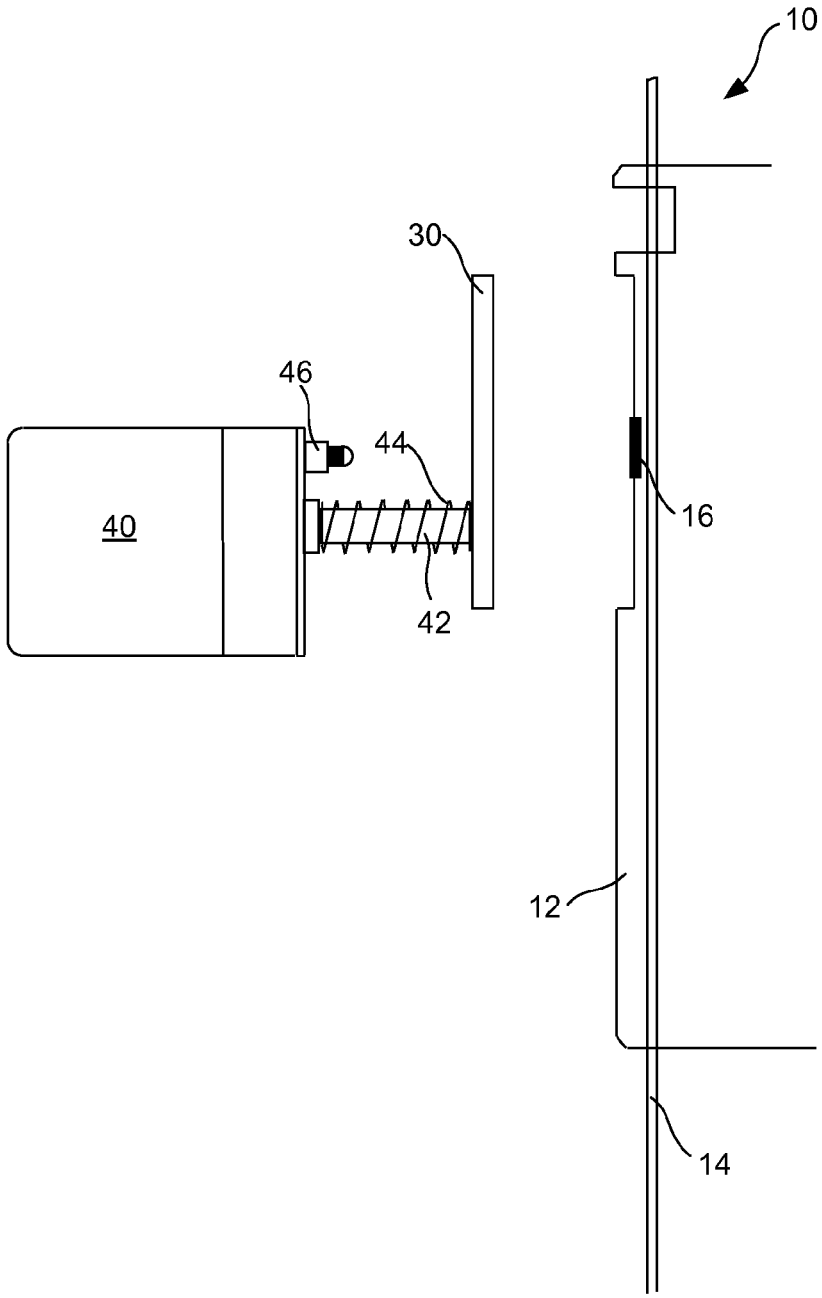
FIG. 5 is a drawing of an example of a side sectional view of the circuit breaker of FIG. 1 and an actuator with an alignment fixture of FIG. 3 according to various embodiments of the present disclosure.

FIG. 5 is a drawing of a non-limiting example of a side view showing the portable actuator 40 having the alignment fixture 30 mounted thereon in relation to the circuit breaker assembly 10 comprising the circuit breaker 12 within the sheet metal enclosure 14. The alignment fixture 30 is mounted to the portable actuator 40 via the moveable guide shafts 42 extended by the compression springs 44. As illustrated, when the alignment fixture 30 is aligned with the recessed area 19 of the circuit breaker 12, a linear actuator 46 is aligned with a corresponding control component 16. Accordingly, while the alignment fixture 30 is an intermediary component between the portable actuator 40 and the circuit breaker 12, the alignment fixture 30 is used to properly align the control component 16 with the linear actuator 46 so that the linear actuator 46 may extend from the portable actuator 40 and engage with the corresponding control component 16 when triggered by the portable actuator 40.

Figure 6:
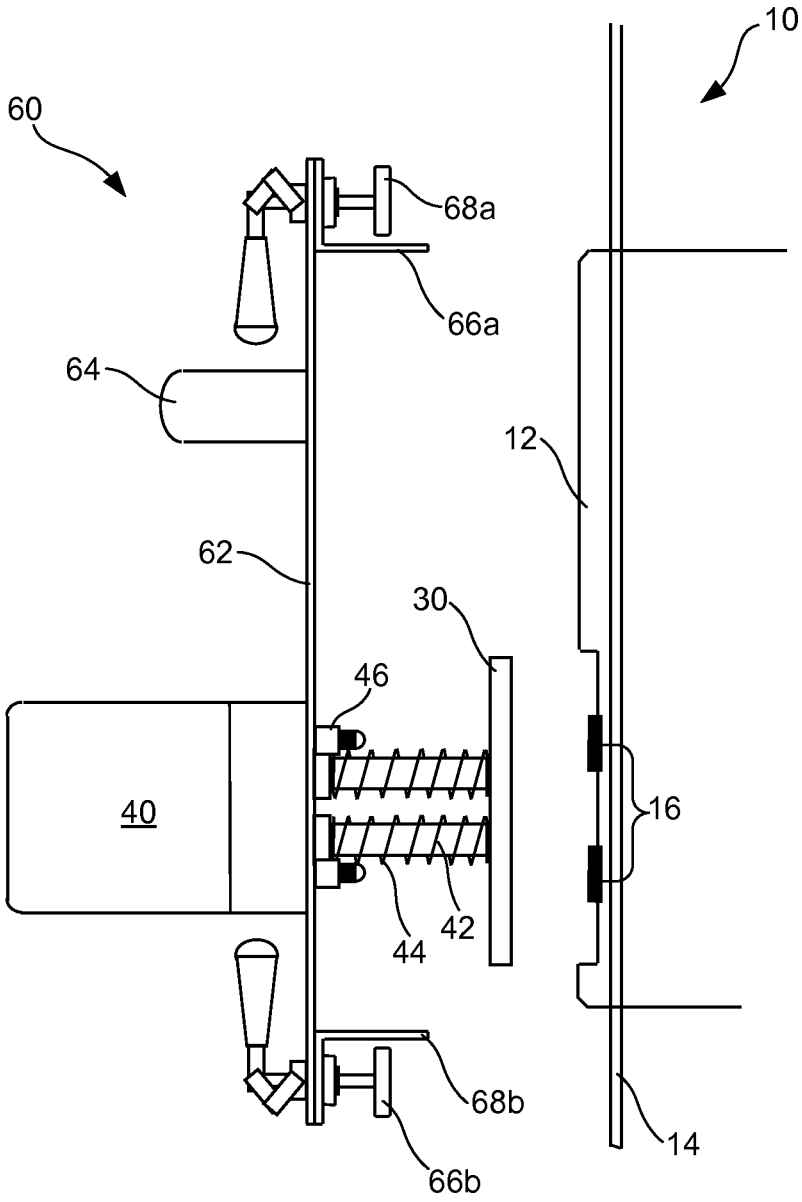
FIG. 6 is drawing of an example of a top view of a portable actuator with the alignment fixture of FIG. 3 positioned relative to the circuit breaker of FIG. 1 according to various embodiments of the present disclosure.
Figure 7:
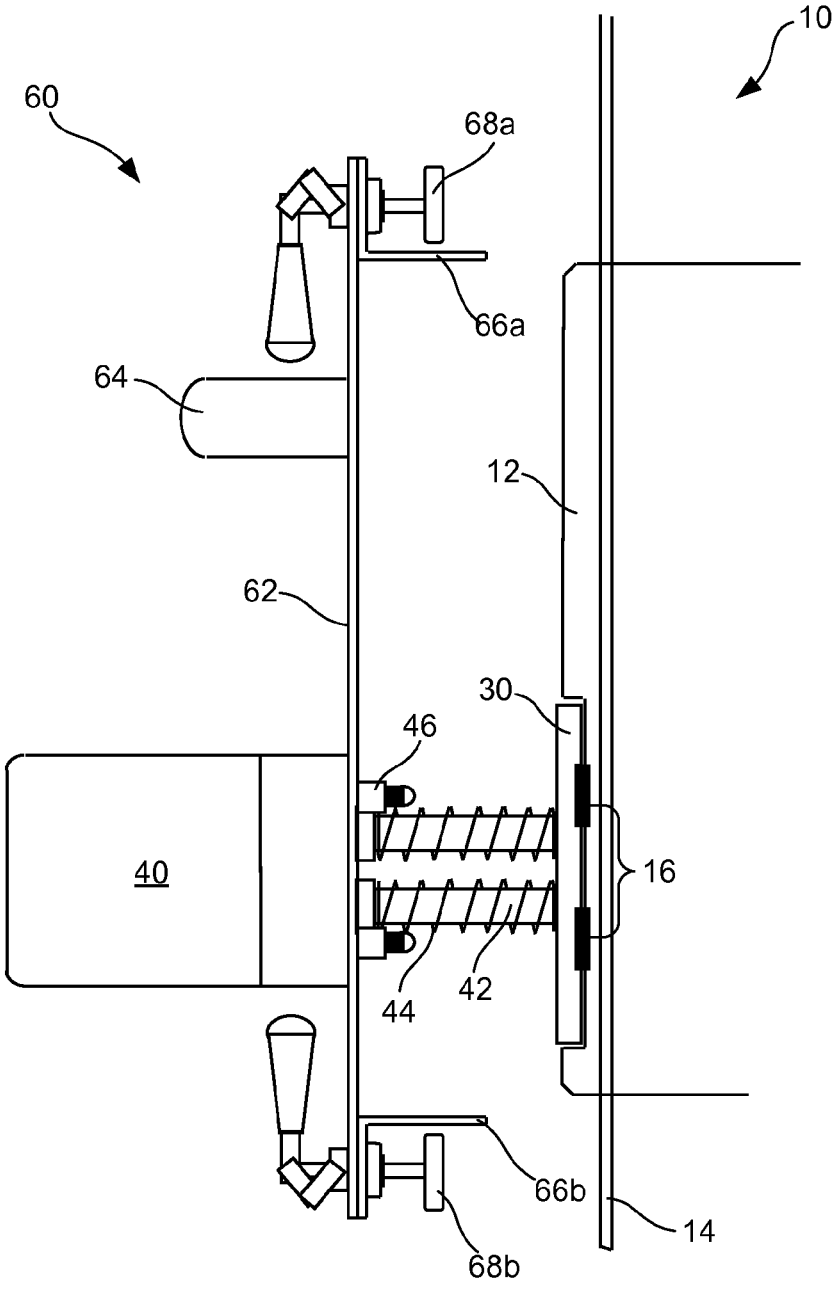
FIG. 7 is a drawing of an example of a top view of a portable actuator with the alignment fixture engaging the recessed feature of the circuit breaker face.
Figure 8:
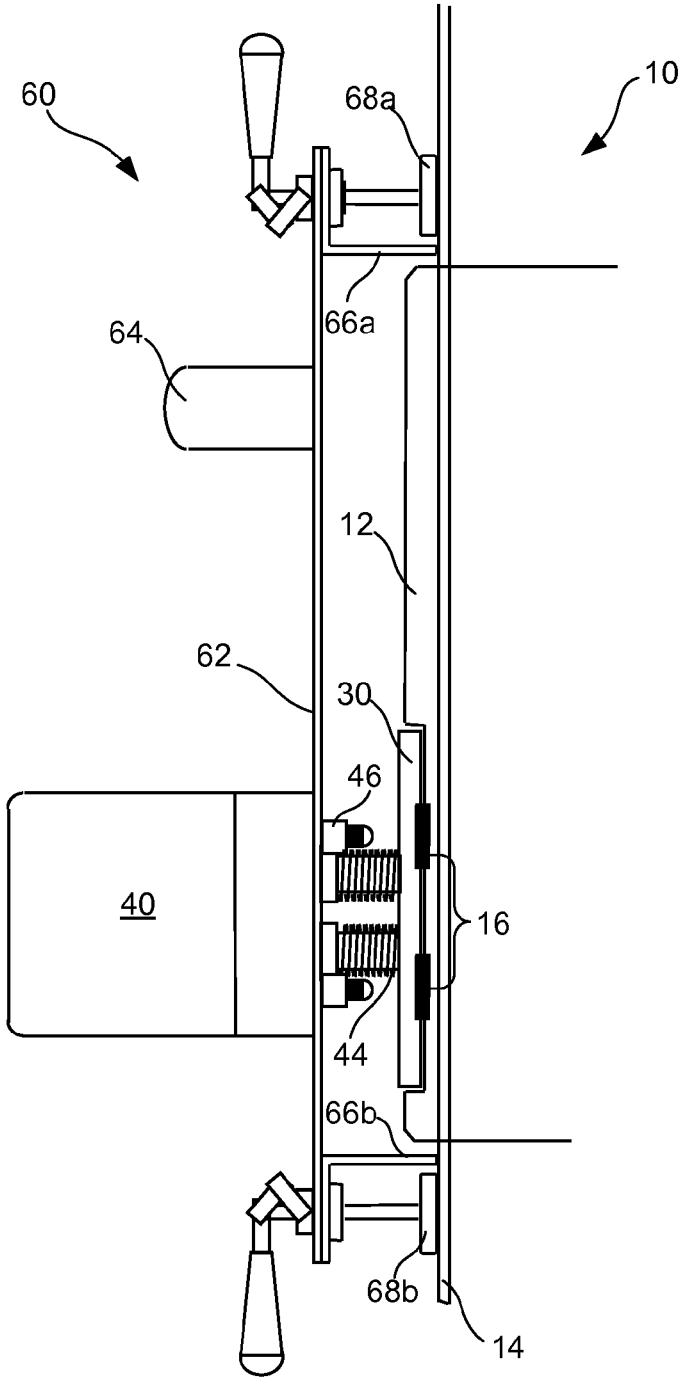
FIG. 8 is a drawing of an example of a top view of a portable actuator with the alignment fixture of FIG. 3 fully engaging the circuit breaker of FIG. 1, with an attachment component of the portable actuator being attached to an enclosure of the circuit breaker according to various embodiments of the present disclosure.

FIGS. 6-8 depict drawings of non-limiting examples of the progression of installing a portable actuator assembly 60 onto a circuit breaker assembly 10 as viewed from above according to various embodiments of the present disclosure. The portable actuator assembly 60 comprises a portable actuator 40, an alignment fixture 30, a frame 62, a handle, 64, frame angles 66*a*, 66*b*, and attachment components 68*a*, 68*b*. The alignment fixture 30 is mounted to the portable actuator 40 via the moveable guide shafts 42 extended by compression springs 44. The attachment components 68*a*, 68*b* are used to secure the portable actuator assembly 60 to the circuit breaker assembly 10. For example, assuming the attachment components comprise strong magnets as illustrated, the magnetic force from the attachment components 68*a*, 68*b*, and the sheet metal enclosure 14 hold the alignment fixture in constant force against the face of the circuit breaker 12. It should be noted that while the attaching components 68*a*, 68*b* are shown to be magnets, the attaching components 68*a*, 68*b* may comprise suction cups and/or other appropriate mechanism for temporarily detachably securing the portable actuator assembly 60 to the circuit breaker assembly 10.

Referring to FIG. 6, shown is a drawing of a non-limiting example of a top view of the portable actuator assembly 60 approaching the circuit breaker assembly 10 according to various embodiments of the disclosure. The alignment fixture 30 is fully extended as a result of the compression springs 44 forcing the alignment fixture 30 to the extreme travel of the moveable guide shafts 42. This ensures that the alignment fixture 30 contacts the recessed area 19 on the face of the circuit breaker 12 before the portable actuator frame angles 66*a*, 66*b* contact the sheet metal enclosure 14.

Moving on to FIG. 7, shown is a drawing of a non-limiting example of the alignment fixture 30 in full contact with recessed area 19 of the circuit breaker 12 according to various embodiments of the disclosure. The attachment components 68*a*, 68*b* are retracted and the frame angles 66*a*, 66*b* have not yet contacted the circuit breaker sheet metal enclosure 14.

Turning now to FIG. 8, shown is a drawing of a non-limiting example of the portable actuator assembly 60 fully attached to the power circuit breaker assembly 10. The moveable guide shafts 42 have moved into the housing of the portable actuator 40, compressing the compression springs 44, holding the alignment fixture 30 tightly into the recess area 19 of the circuit breaker 12, ensuring the linear actuators 46 are accurately aligned with the corresponding control components 16 (e.g., an ON linear actuator with an ON pushbutton and an OFF linear actuator with an OFF pushbutton).

Figure 9:
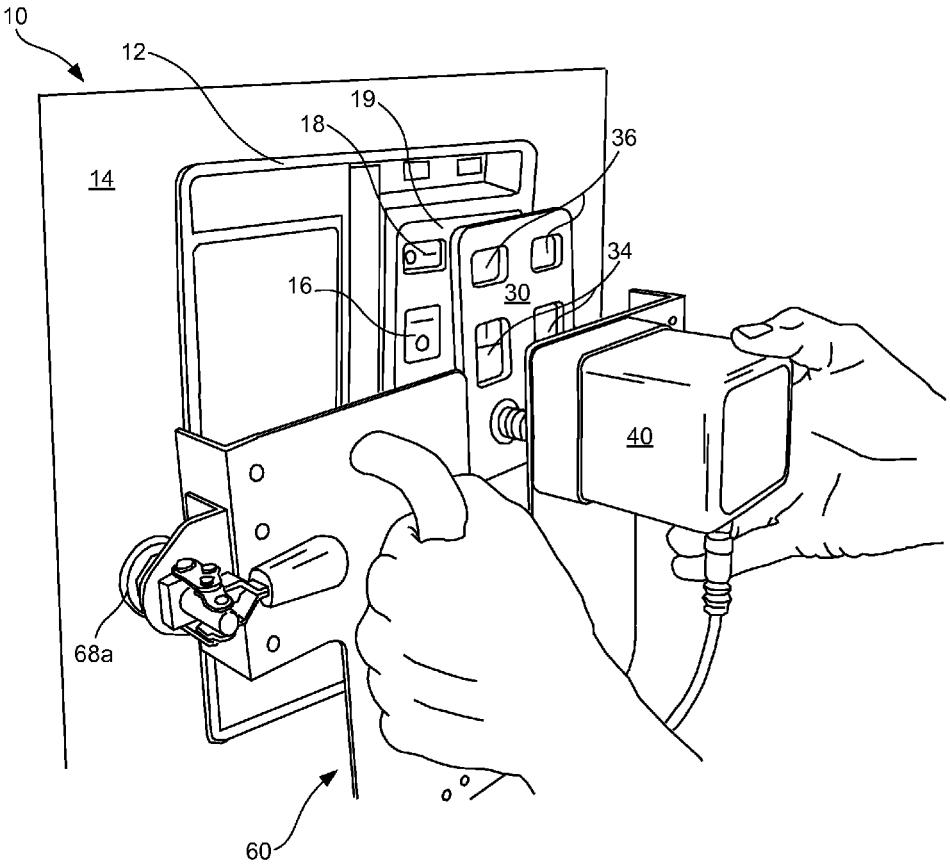
FIG. 9 is a drawing of an example of a perspective view of the portable actuator with the alignment fixture of FIG. 3 being installed on the circuit breaker of FIG. 1 according to various embodiments of the present disclosure.

Moving on to FIG. 9, shown is a drawing of a non-limiting example of a perspective view with the portable actuator assembly 60 in approximately the same position as shown in FIG. 6. Additionally, FIG. 9 illustrates an operator positioning the alignment fixture relative to the circuit breaker. As discussed with reference to FIG. 6, the alignment fixture 30 is fully extended from the portable actuator 40 and the compression springs 44 are not compressed.

Figure 10:
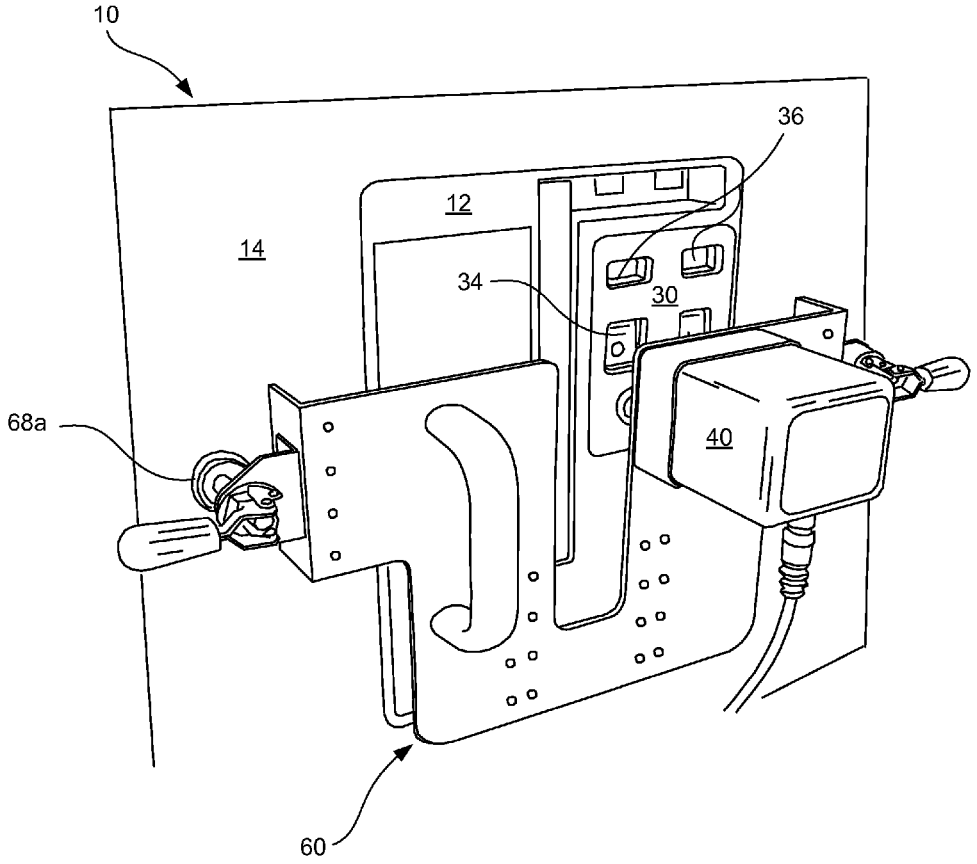
FIG. 10 is a drawing of an example of a perspective view of the portable actuator with alignment fixture of FIG. 3 attached to the circuit breaker of FIG. 1 according to various embodiments of the present disclosure.

Referring next to FIG. 10, shown is a drawing of a non-limiting example of a perspective view of the portable actuator assembly 60 fully engaged with the circuit breaker assembly 10, similar to the engagement shown in FIG. 8. Accordingly, the control apertures 34 of the alignment fixture 30 are accurately aligned with the corresponding control components 16 of the circuit breaker 12. Further, the moveable guide shafts 42 have slid into the housing of the portable actuator 40 thereby compressing the corresponding compression springs 44. The portable actuator assembly 60 is securely attached to the sheet metal enclosure 14 surrounding the circuit breaker 12.

Figure 11:
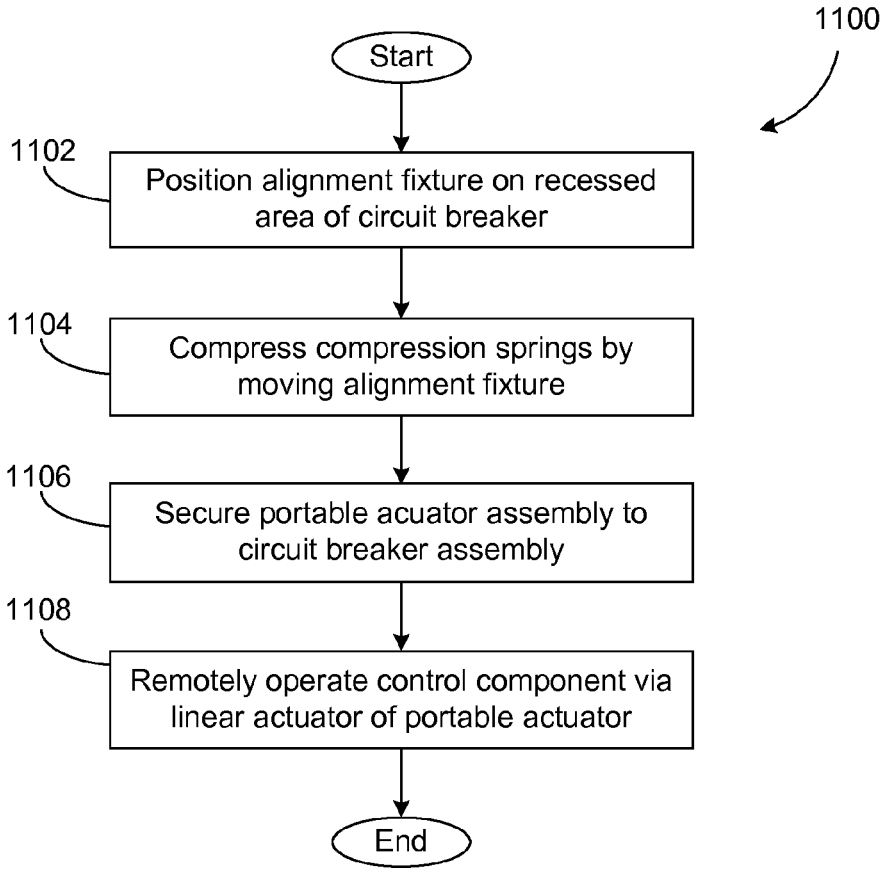
FIG. 11 is a flowchart illustrating a method of aligning the portable actuator with the alignment fixture of FIG. 3 to the circuit breaker of FIG. 1 according to various embodiments of the present disclosure.

With reference to FIG. 11, shown is a flowchart that provides a non-limiting example of a method 1100 of various embodiments of the present disclosure. It is understood that the flowchart of FIG. 11 merely provides examples of the many different types of functional arrangements that may be employed to implement the operation of the methods as described herein.

At reference numeral 1102, a portable actuator assembly 60 (FIG. 6) comprising an alignment fixture 30 (FIG. 3) mounted onto a portable actuator 40 (FIG. 4) is positioned such that the alignment fixture 30 is accurately aligned within a recessed area 19 (FIG. 1) of a circuit breaker 12 (FIG. 1). As previously discussed, the alignment fixture 30 may be designed to approximate the size and shape of the recessed area 19 of the circuit breaker 12. In addition, the alignment fixture 30 may comprise control apertures 34 that correspond to the control components 16 (FIG. 1) of the circuit breaker 12. The control apertures 34 provide access for the portable actuator 40 to the control components 16 such that the linear actuators 46 (FIG. 4) may engage with the appropriate control component 16 when triggered by the portable actuator 40. In some embodiments, the alignment fixture 30 may comprise status apertures 36 that provide a viewing access to the status components 18 of the circuit breaker 12. Accordingly, the alignment fixture 30 may accurately align within the recessed area 19 of the circuit breaker 12 allowing access to the control components 16 and/or status components 18.

At reference numeral 1104, to compensate for variations of distance 20*a*, 20*b* between the plane of the face of the circuit breaker 12 and the plane of the face of the sheet metal enclosure 14 (FIG. 1), the alignment fixture 30 moves and is forced toward the face of the circuit breaker 12 by means of compression springs 44 extending the moveable guide shafts 42. As the compression springs 44 are compressed the moveable guide shafts 42 are moved into the housing of the portable actuator 40.

At reference numeral 1106, the portable actuator assembly 60 is secured to the circuit breaker assembly 10 when the alignment fixture 30 of the portable actuator assembly 60 is appropriately aligned to compensate for the distance 20*a*, 20*b* between the plane of the face of the circuit breaker 12 and the plane of the sheet metal enclosure 14. The attachment components 68*a*, 68*b* are used to secure the portable actuator assembly 60 to the circuit breaker assembly 10. For example, if the attachment components 68*a*, 68*b* comprise strong magnets, the magnets may attach to the sheet metal enclosure 14 of the circuit breaker assembly 10 and secure the portable actuator assembly 60 to the circuit breaker assembly 10 for remote use. At reference numeral 1108, the user may remotely trigger the portable actuator 40 to operate the appropriate linear actuator 46 to engage the corresponding control component 16 of the circuit breaker 12.

Although the flowchart of FIG. 11 shows a specific order of execution, it is understood that the order of execution may differ from that which is depicted. For example, the order of execution of two or more steps may be scrambled relative to the order shown. Also, two or more steps shown in succession in FIG. 11 may be executed concurrently or with partial concurrence. Further, in some embodiments, one or more of the steps shown in FIG. 11 may be skipped or omitted.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, at least the following is claimed:

1. An apparatus for remotely operating circuit breakers, the apparatus comprising:

a portable actuator comprising one or more linear actuators that are designed to operably extend from a housing of the portable actuator and engage with one or more control components positioned within a recessed area of a circuit breaker;

an alignment fixture comprising one or more apertures, the alignment fixture being mounted to one or more moveable guide shafts extending from a face of the portable actuator such that the one or more apertures are substantially aligned with the one or more linear actuators, and the alignment fixture being designed to engage and substantially align with the recessed area of the circuit breaker thereby providing access for the one or more linear actuators to engage with the one or more control components; and one or more attachment components configured to attach the apparatus to an enclosure surrounding the circuit breaker, wherein the one or more attachment components comprise magnets.

2. The apparatus of claim 1, wherein the one or more moveable guide shafts are moveably mounted to the portable actuator and are configured to move along an axis perpendicular to the face of the portable actuator.

3. The apparatus of claim 1, wherein the alignment fixture is an approximate size and an approximate shape of the recessed area.

4. The apparatus of claim 1, wherein the alignment fixture is moveable along an axis perpendicular to the face of the portable actuator.

5. The apparatus of claim 1, wherein the alignment fixture is held in constant force against the face of the circuit breaker based at least in part on corresponding compression springs extending individual ones of the one or more moveable guide shafts when the alignment fixture is engaged with the face of the circuit breaker.

6. The apparatus of claim 1, wherein the alignment fixture is held in constant force against the face of the circuit breaker by means of magnetic force.

7. The apparatus of claim 1, wherein individual ones of the one or more moveable guide shafts are extended by a corresponding compression spring.

8. The apparatus of claim 7, wherein the corresponding compression spring compresses when force is applied to a face of the alignment fixture.

9. A system comprising, a circuit breaker assembly comprising a circuit breaker surrounded by a metal enclosure, the circuit breaker assembly including a control component positioned within a recessed area of the circuit breaker; and a portable actuator assembly attached to the circuit breaker assembly, the portable actuator assembly comprising:

a portable actuator having a linear actuator for engaging with the control component of the circuit breaker and one or more moveable guide shafts, the linear actuator and the one or more moveable guide shafts extending from a face of the portable actuator, wherein individual ones of the one or more moveable guide shafts are extended by a corresponding compression spring; and an alignment fixture mounted to the portable actuator via the one or more moveable guide shafts, the alignment fixture comprising an aperture in alignment with the linear actuator and being approximately sized and shaped to be substantially aligned with the recessed area of the circuit breaker.

10. The system of claim 9, wherein the linear actuator accesses the control component via the aperture of the alignment fixture.

11. The system of claim 9, wherein the alignment fixture is held in constant force against the face of the circuit breaker based at least in part on compression springs extending the one or more moveable guide shafts.

12. The system of claim 9, wherein the alignment fixture is moveable along an axis perpendicular to the face of the circuit breaker.

13. The system of claim 9, wherein the one or more moveable guide shafts are configured to move along an axis perpendicular to the face of the portable actuator.

14. The system of claim 9, wherein the portable actuator assembly further comprises one or more attachment components that are used to detachably attach the portable actuator assembly to the circuit breaker assembly.

15. A method for aligning a portable actuator assembly to a circuit breaker, the method comprising:

positioning an alignment fixture of the portable actuator assembly on the circuit breaker such that an aperture of the alignment fixture is aligned with a control component of the circuit breaker, the alignment fixture being mounted to a portable actuator via one or more moveable guide shafts extending from a face of the portable actuator;

moving the alignment fixture to compress compression springs extending the one or more moveable guide shafts; and securing the portable actuator assembly to a metal enclosure surrounding the circuit breaker to maintain a constant force between the alignment fixture and the circuit breaker.

16. The method of claim 15, further comprising moving the alignment fixture along an axis perpendicular to the face of the portable actuator.

17. The method of claim 16, wherein the one or more moveable guide shafts move within a housing of the portable actuator as the compression springs compress.

* * * * *